United States Patent [19]

Gates et al.

[11] 4,085,671

[45] Apr. 25, 1978

[54] TORQUE LIMITING USED SCREEN TAKE-UP ASSEMBLY AND DRIVE

[75] Inventors: Albert George Ronald Gates; Michael Maynard, both of London, England

[73] Assignee: Gestetner Limited, London, England

[21] Appl. No.: 735,776

[22] Filed: Oct. 26, 1976

[30] Foreign Application Priority Data

Oct. 27, 1975 United Kingdom ..... 44139/75

[51] Int. Cl.[2] ..... B41F 15/12; B41F 15/38

[52] U.S. Cl. ..... 101/128.1; 101/116; 101/122; 242/68.1; 242/68.5; 242/75.5

[58] Field of Search ..... 101/116, 122, 127.1, 101/128.1; 242/68, 68.1, 68.2, 68.3, 68.4, 68.5, 67.3, 75.5, 200

[56] References Cited

U.S. PATENT DOCUMENTS

| | | | |
|---|---|---|---|
| 2,009,972 | 7/1935 | Marcher et al. | 242/68.4 |
| 3,348,786 | 10/1967 | Miller et al. | 242/200 |
| 3,727,856 | 4/1973 | Kitch | 242/75.5 |
| 3,940,081 | 2/1976 | Kubicki, Sr. | 242/68.5 |
| 3,943,850 | 3/1976 | Maynard | 101/127.1 |

*Primary Examiner*—Ronald E. Suter

*Attorney, Agent, or Firm*—Fleit & Jacobson

[57] ABSTRACT

For the purposes of removing a used stencil or an ink screen from the cylinder(s) of a duplicator, a rotatable core alongside the duplicator cylinder is driveable by a drive transmission from the main duplicator drive, by way of a freewheel clutch such that the core is driven only when the duplicator cylinder is rotated in the reverse direction as compared with the normal direction of rotation during printing, and also by way of a friction-slip connection arranged such that with no slip the peripheral speed of the core is higher than that of the duplicator cylinder along which it is mounted.

11 Claims, 8 Drawing Figures

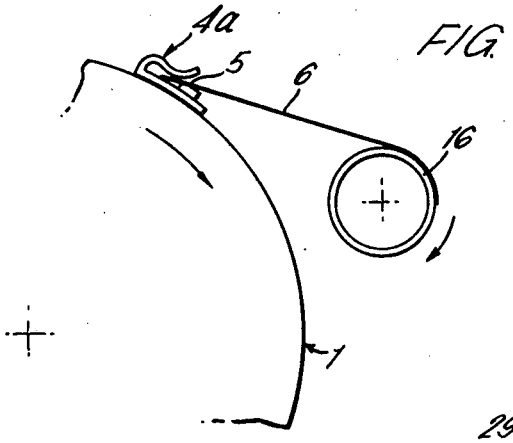
FIG. 4A.
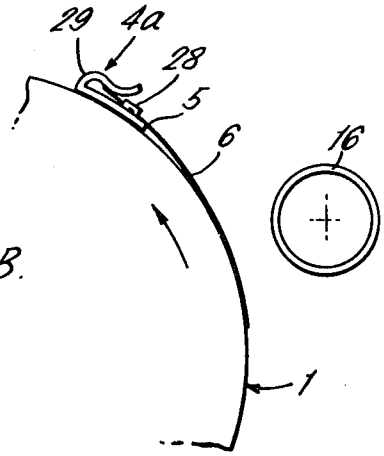
FIG. 4B.
FIG. 5A.
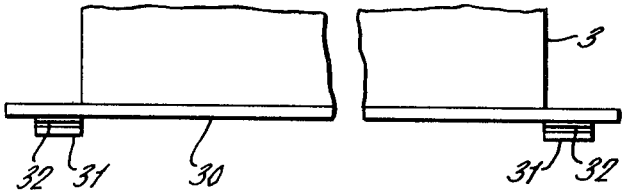
FIG. 5B.
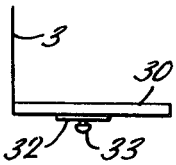

TORQUE LIMITING USED SCREEN TAKE-UP ASSEMBLY AND DRIVE

The present invention relates to stencil duplicators, and in particular to a duplicator including means for temporarily storing a stencil or ink screen (silk screen) removed from the duplicator cylinder or cylinders.

In the past it has been known for a considerable number of used stencils automatically to be ejected successively into a spiral build-up of blotting web on a receiving roller as disclosed in U.S. Pat. No. 3,788,221 (Borneman). However, this makes no provision for reusing individual stencils.

Our earlier German Offenlegungsschrift No. 2346447 discloses a system for rolling up a used stencil or an ink screen from a duplicator on a core frictionally driven by drive wheels rolling on the surface of the duplicator cylinder. This needs a cumbersome drive train of rocking levers and requires manual operation to activate the drive to the core. Moreover, the use of drive wheels rolling on the surface of the stencil cylinder obstructs the stencil cylinder.

It is the aim of the present invention to provide a more compact, semi-automatic system in which a stencil can be wound directly onto a single core, either for the purposes of rapid disposal of the stencil or ink screen or for rapid re-location and re-use of the stencil or ink screen at some later time, without the need for operator-initiated activation of drive to the core and with a minimum of contact between the inked stencil or ink screen and the duplicator operator.

According to the present invention we provide a duplicator having: at least one cylinder with a stencil-supporting screen mounted on the cylinder for circulating the stencil about the axis of rotation of the cylinder while ink is applied to one side of the stencil, in use of the duplicator; means for mounting a core alongside the cylinder or one of the cylinders; and a drive transmission between the drive to the stencil-circulating cylinder and the core supporting means for driving the core at a peripheral speed higher than the peripheral speed of the cylinder adjacent which the core is mounted, said drive transmission incorporating both a torque-limiting slip facility between the duplicator drive and the core, and also a one-way clutch to ensure that drive to the core can only occur during rotation of the duplicator cylinder or cylinders in a sense of rotation opposite to the normal sense of rotation applicable during printing.

Conveniently, the said core may be in the form of a rigid tube frictionally driven for rotation by the above-mentioned drive transmission. More conveniently, the tube may have a longitudinal slot extending from close to one end of the tube right up to the other end of the tube for receiving the heading bar and springs of an ink screen of a stencil duplicator.

More specifically the invention provides a twin cylinder stencil duplicator having: an ink screen mounted on the cylinder for circulation about the two cylinders; means for attaching a stencil to the ink screen for circulation with the ink screen while ink is applied to one side of the stencil, in use of the duplicator; a cylindrical member releasably mounted alongside the upper of the two duplicator cylinders; and a drive transmission between the drive to the stencil-duplicator cylinders and the cylindrical member for driving the cylindrical member at a peripheral speed higher than the peripheral speed of the cylinder adjacent which the cylindrical member is mounted, said drive transmission incorporating both a friction drive connection to limit the maximum drive torque transmissable to the cylindrical member and also a one-way clutch to ensure that drive to the cylindrical member can only occur during rotation of the duplicator cylinders in a sense of rotation opposite to the normal sense of rotation applicable during printing.

Preferably, drive to the core is by way of a drive belt direct from the main drive of the duplicator, and slip of the belt provides the frictional coupling to the core.

Suitably the core may comprise a sleeve frictionally carried by a rotatable support member and in thise case the torque-limiting friction-slip connection is, at least in part, provided by the frictional engagement of the sleeve on the support member. Advantageously, the sleeve may consist of a tube of paper or card folded flat about fold lines extending along diametrically opposite generatrices.

In order that the present invention may more readily be understood the following description is given, merely by way of example, with reference to the accompanying drawings, in which:

FIGS. 4A and 4B show in side elevational view operation with an automatically opening stencil clamp;

FIGS. 5 and 5A illustrate a form of ink screen bottom bar which facilitates screen removal with the apparatus of FIG. 2.

Figure 1:
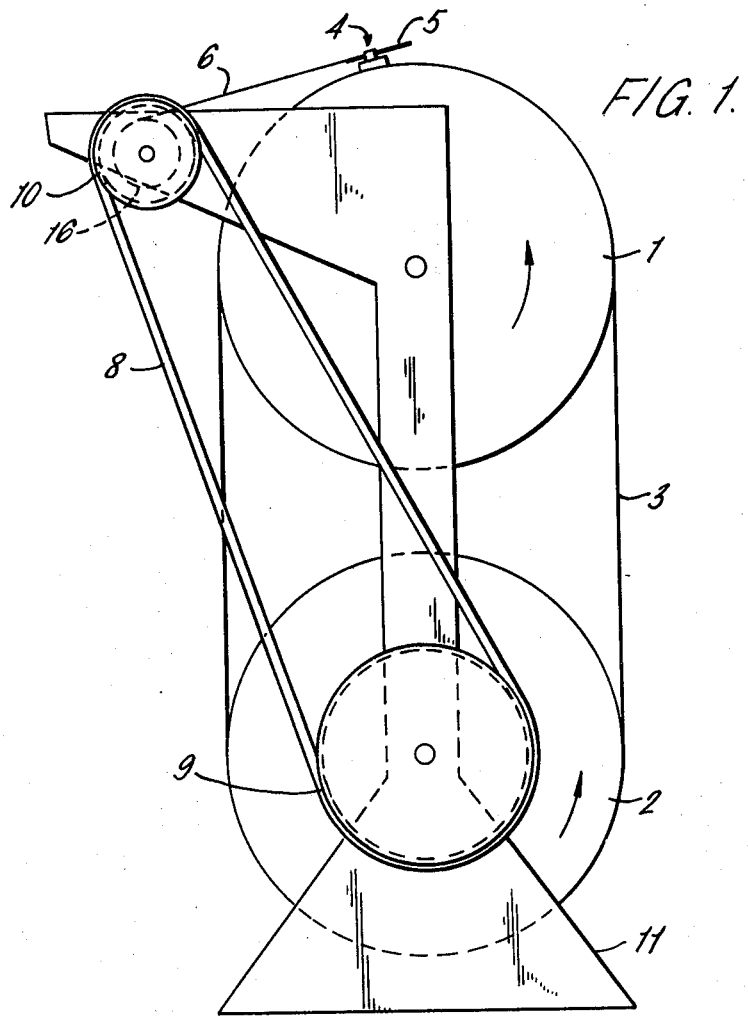
FIG. 1 is a side elevational view of a duplicator according to the present invention.

FIG. 1 shows in side elevational form the upper and lower duplicator cylinders 1 and 2, respectively, supporting an ink screen 3 (sometimes referred to as the 'silk screen') and a clamp 4 to receive the heading 5 of a stencil 6. The stencil 6 is being withdrawn from the clamp 4 towards a roller 16 which is rotatably driven in the anti-clockwise sense by means of a circular section driving belt 8 of plastics material entrained around both a driving pulley 9 on the lower duplicator cylinder 2 and a driven pulley 10 carried by the righthand machine frame 11 of FIG. 2 (see also FIG. 1).

Figures 2, 3:
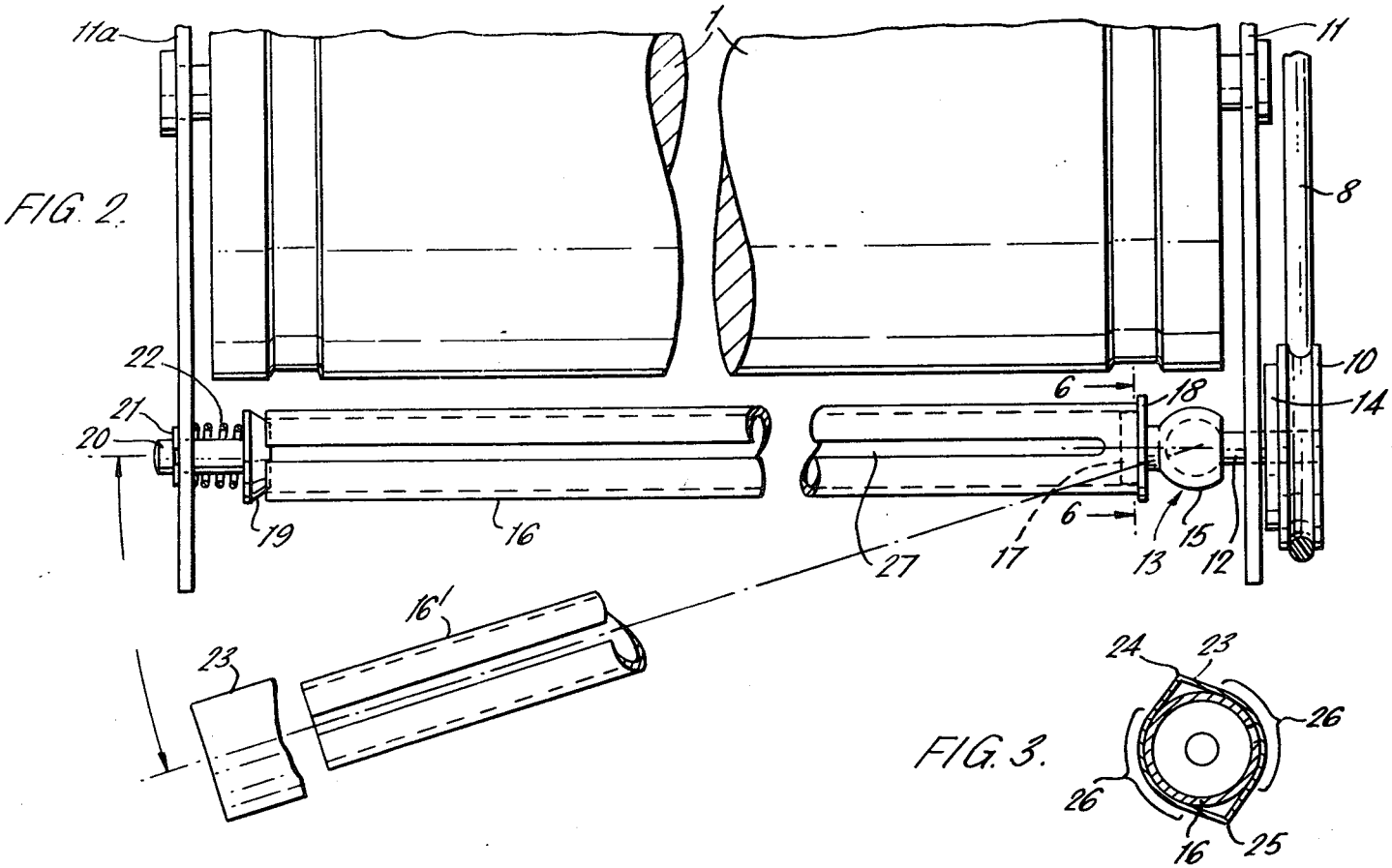
FIG. 2 is a top plan view of the duplicator of FIG. 1 but with the ink screen and drive belts removed.
FIG. 3 is a detail section taken through the core tube and core sleeve of FIG. 2.

As shown more clearly in FIG. 2, the driven pulley 10 is mounted coaxially with a stub shaft 12 supporting the ball of a drive-transmitting universal ball joint 13, drive from the driven pulley 10 being transmitted by way of a one-way clutch device (i.e. a freewheel clutch) 14 formed integrally with, and drivingly connecting together, the pulley 14 and the stub shaft 12 of the ball joint 13. The arrangement is such that when the cylinders 1 and 2 of the duplicator are rotating in the clockwise direction there will be no drive to the ball joint 13, but drive will ensue when the cylinders 1 and 2 are rotating in the anti-clockwise sense.

The driven member 15 of the ball joint 13 carriers the roller 16, in this case a tube for supporting a sleeve or core on which the stencil is to be wound up. The tube 16 fits onto a plug 17 and abuts an end flange 18.

At the other side frame 12 of the machine is a frusto-conical, rotatable idler guide member 19 carried at the righthand end of an axially slidable, freely rotatable spindle 20 the rightward movement of which is limited by means of a circlip 21. The spindle 20 is in any case biased rightwardly by means of a compression spring 22 so that the circlip 21 will always be biased against the outer surface of the side frame 12, as shown in FIG. 2.

FIG. 2 also illustrates an alternative position 16' of the supporting tube 16 illustrating the fact that its left-hand end, as viewed in FIG. 2, can be swung away from the operative position in which it is engaged by the frusto-conical guide member 19 and into a position clear of the side frame 12 where a core sleeve 23 supported on the tube 16 can be removed. This swinging action is made possible by the ball joint 13 between the stub shaft 12 and the plug member 17 supporting the tube 16.

Because of the one-way drive made possible by the freewheel clutch 14, when the stencil cylinders 1 and 2 are rotating in the clockwise direction during a printing run there will be no drive to the tube 16 which can then be swung to its out-of-the-way position to release the sleeve 3 for replacement by an empty core. Drive automatically ensues when the duplicator cylinders 1 and 2 are rotated in the anti-clockwise direction to feed the stencil towards the core sleeve 23.

As shown in the transverse sectional view of FIG. 3, the core sleeve 23 is in the form of a flat paper sleeve which, when spread open and placed around the tube 16, adopts a "lemon-shaped" cross section in that it is substantially circular to conform with the periphery of the tube 16 but has apices 24 and 25 coinciding with the fold lines in the flat sleeve.

This embodiment of core sleeve has the advantage that it can readily be packaged for transport and sale, for example by providing packs of 100 flat sleeves which can then be opened by the operator of the duplicator and used individually.

Because of the initially flat configuration of the paper sleeve 23, once the sleeve has been spread open and placed over the tube 16 it will cling frictionally to the tube 16 over those cylindrical portions 26 of the core remote from the apices 24 and 25 where the natural tendency of the sleeve 23 to return to its flat configuration causes pressing contact between the sleeve 23 and tube 16. This provides a frictional engagement between the sleeve 23 and the tube 16 so that slip can occur when a stencil spans the gap between the sleeve 23 and the stencil clamp 4 so that the required degree of overdrive, in this case 10% (i.e. a ratio of surface speed of the tube 16 to the cylinder 1 equal to 11:10) does not tear the stencil 6. Tension will thus be maintained in the stencil but will be limited by the frictional engagement between the core 23 and tube 16.

The tube 16 has a slot 27 extending therealong and open at the free end of the tube 16. This allows an ink screen to be attached to the tube 16 directly without the need for a sleeve 23. The springs and heading of the ink screen can be placed within the tube 16 so that the ink screen engages in the slot 27 and then rotation of the cylinders 1 and 2 in the anti-clockwise sense will cause the ink screen to be rolled up on the tube 16.

When the tube 16 has an ink screen coiled on it, it can be removed from the plug member 17 by simply pulling it away from the flange 18, and the screen and tube 16 can then be stored while an ink screen of a different colour is in use. For this purpose there will be several tubes 16 available so that a fresh tube can be placed in position and can be used to support the alternative ink screen while the first screen is being reattached to the duplicator.

There are two possible ways of generating the necessary rotational slip between the drive to the tube 16 and the main drive of the duplicator.

In one form, this slip may be generated by arranging for the flange 18 to be a friction fit against the right-hand end of the tube 16, as viewed in FIG. 2, so that as the driven member 15 of the universal ball joint rotates it entrains the tube 16 by frictional contact.

A second possibility, which will in most cases be available in addition to any slipping drive provided by frictional engagement between the flange 18 and the tube 16, is that the circular section belt 8 will be able to slip relative to either the driven pulley 10 or the drive pulley 9 of FIG. 1 and this then provides a protection against rupture of the stencil or ink screen during feed.

The maximum drive torque transmissable to the driven pulley 10 will depend upon the frictional grip of the belt 8 with its pulleys 9 and 10 and will be such that when slip just occurs elsewhere in the system, for example at the frictional engagement between the flange 18 and the tube 16 or by virtue of the frictional engagement between the tube 16 and the flat sleeve 23 when a stencil is being withdrawn onto the sleeve 23, the belt 8 will still be driving the pulley 10 without rotational slip occurring at either the drive pulley 9 or the driven pulley 10.

Where the device has been used to feed a stencil with the intermediary of the flat paper tube 23, the arrangement will be such that slip occurs between the sleeve 23 and the tube 16 before slip is possible between the flange 18 and the tube 16, in the case of slip at the drive end of the tube 16 being provided for.

It may, however, be desirable for the sleeve 16 to be made such that it will fit over the boss 17 carried by the flange 18 in rotation drive-transmitting relationship at least during rotation of the duplicator cylinder 1 in the reverse sense of rotation.

Figure 6:
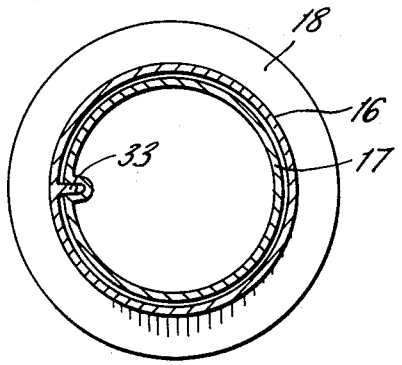
FIG. 6 shows a detail of FIG. 2 in the form of a cross-section on the line 6-6 of FIG. 2.

This may be assured by providing a keying spigot on the boss 17 to engage with a suitable formation within the tube 16 to prevent rotational slip occurring (rotational slip is in any case already possible by virtue of the frictional engagement between the belt 8 and the pulleys 9 and 10). Such a keying spigot arrangement is illustrated at 32 in FIG. 6 which shows a cross-section on line 6—6 of FIG. 2.

As an alternative possibility for ensuring drive transmitting engagement when the tube 16 is removably securable to the driven member 15, the internal wall of the tube 16 at the right-hand end, as shown in FIG. 2, may be given a female thread (not shown) to co-operate with a male thread on the external wall of the spigot 17 with the hand of the thread arranged such that driving rotation to the driven member 13 in use of the stencil-receiving tube 16 to drag a stencil or ink screen from the duplicator cylinder 1 will tend to tighten the engagement of the threads. Since drive in the opposite direction will only occur when the stencil or ink screen has been removed from the stencil-receiving rotor assembly and the cylinder 1 is rotating in the printing direction there will be no drag on the tube 16 which might tend to unscrew it from the boss 17.

A typical operating cycle of the device illustrated would be as follows.

While a first stencil is being used and is carried by the heading clamp 4, the cylinders 1 and 2 will be rotating in the clockwise direction and there will be no drive to the tube 16. The spindle 20 can then be withdrawn to the left in FIG. 2 against the yieldable resistance of the compression spring 22 to allow the tube 16 to be swung into the 16' position. The spindle 20 can then be released and a flat sleeve 23 spread into the open position and placed over the tube 16 until it abuts the end flange 18 carried by the driven member 15 of the ball joint. Once the sleeve 23 is in position on the tube 16 the spindle 20 can again be withdrawn to allow the tube 16 to be swung back into the operating position and then when the spindle 20 is released the guide member 19 will automatically centre the tube 16 in its operating position.

To simplify this movement there may be some control (not shown) provided on the machine for enabling simple withdrawal of the spindle 20. For example, a handle may be provided on the spindle, on the lefthand end as viewed in FIG. 2.

When the stencil currently in use is to be withdrawn, while the cylinders 1 and 2 are stationary the tail end of the stencil is placed on the top of the core 23 to which it will attach itself by the adhesive action of the ink and moisture in the stencil. This is the only part of the operation which requires manual handling of the stencil and the operator could easily use tweezers or other suitable implements to avoid touching the inky stencil.

The duplicator is then operated in the reverse sense (using either the operating handle, or a "reverse" switch to the machine drive, if available) to rotate the cylinders 1 and 2 in the anti-clockwise direction causing the one-way clutch 14 to drive the tube 16 in the anti-clockwise sense as viewed in FIG. 1 and thereby to roll up the inky stencil onto the sleeve 23. Once the stencil arrives at the position illustrated in FIG. 1, with the stencil heading clamp 4 at or just past its top dead-centre position on the cylinder 1, unless the clamp 4 is designed to open automatically as the direction of the tension becomes increasingly closer to a radial direction, the clamp must be opened to release the stencil heading card 5 so that further rotation of the duplicator in the anti-clockwise direction will cause completion of the rolling up action on the sleeve 23.

A clamp **4*a*, which will automatically release the stencil or screen, is shown in FIGS. 4A and 4B** and will be described later.

If re-use of the duplicator is required, it is a simple matter to reload the duplicator with a fresh stencil before removal of the inky stencil from the tube 16 and this, followed by resumption of rotation of the cylinders 1 and 2 and the ink screen 3 in the clockwise direction for the next printing run, will allow the machine to be re-used immediately the stencil heading card 5 has arrived on the inky stencil coiled on the sleeve 23.

During this next printing run, or at the end of the previous printing run if no further use is required, the stencil 6 and core sleeve 23 can be readily removed from the tube 36 by successively (a) withdrawing the spindle 20 leftwardly, (b) swinging the tube 36 into its 16' position, (c) sliding the core sleeve 23 and stencil 6 axially leftwardly off the tube 16 and placing them either in the disposal container or on suitable storage means, (d) spreading open a fresh core sleeve 23 and placing it on the tube 16, and finally (e) restoring the tube 16 to its operative position of FIG. 2 centred on the guide member 19 with the spindle 20 again urged to the right by the compression spring 22.

This procedure may be varied where the ink screen 3 itself is to be removed in that there will, of course, be no need for a core 23. Thus to remove the ink screen 3, it is first of all necessary to disconnect the ink screen to release one end for attachment to the tube 16.

The tube 16 will then be removed from the plug 17 and then carried out to the right of FIG. 2 and subsequently caused to slide leftwardly so as to engage screen 3 with the springs and heading bar of the ink screen inside the tube 16 with the web of the ink screen passed through the slot 27. Once the tube 16 is in a position parallel to the operative position of FIG. 2 and with its righthand end adjacent the plug 17 and end flange 18, the sleeve can be manipulated onto the plug 17 with the driven member 15 of the ball joint pivoted in the position which it will normally adopt during removal and replacement of a core sleeve 23 on the sleeve 16 in the above-described operating cycle for stencil removal.

Once the tube 16 has been placed on the plug 17 it will be a simple matter to swing the tube 16 back into its operative position and to re-engage it with the guide member 19.

When the duplicator cylinders 1 and 2 are then further rotated in the anti-clockwise direction the ink screen will wind itself upon the tube 16 and the required slip in the drive can, for example, be derived at the frictional engagement between the tube 16 and the plug 17 of the driven member 15 of the ball joint.

Once the ink screen has been fully wound up on the tube 16 a fresh ink screen can be mounted on the machine, and the tube 16 with the previous ink screen on it can remain carried by the plug 17 and guide 19 until, at a convenient instant during the next printing run with the alternative ink screen, there will be a chance for the operator to remove that particular ink screen and tube 16 to the appropriate storage means.

Although the member 17 has been referred to throughout above as a plug and it has been indicated that there will be frictional engagement between the plug 17 and the tube 16, the expert will appreciate that it would readily be possible for the member 17 to be small enough in diameter so as not to engage the tube 16 frictionally but nevertheless large enough to serve as a centring member and for the frictional engagement between the driven member 15 and the tube 16 to be derived by way of axial pressing of the tube 16 against the end flange 18 by virtue of the biasing action of the spring 22 behind the frusto-conical guide member 19. In that case, the circlip 21 is unlikely ever to be in abutting engagement with the side frame 12 since the limit of rightward movement of the spindle 20 will be provided by engagement of the guide member 19 in the lefthand end of the tube 16.

Thus, in the present invention, there is always slipping drive to a core which is rotatably driven by the duplicator cylinders. When the sleeve 23 serves as stencil-receiving core the slip arises between the sleeve 23 and tube 16, and when no sleeve 23 is available the core is the tube 16 (for example for coiling up an ink screen 3) and slip arises in the drive to the tube 16, usually at the frictional engagement of the core tube 16 with the flange 18 of the ball joint driven member 15.

In either case the core, either sleeve 23 or tube 16, will be overdriven relative to the cylinders 1 and 2 but take-up tension will be limited to a level which is high enough to ensure smooth application of the stencil or ink screen onto the core 23 or 16, but not sufficiently high to cause deformation or possible rupture of the stencil or ink screen.

FIGS. 4A and 4B, respectively show the operation of an alternative form of stencil heading clamp **4*a* both during automatic withdrawal of the stencil on reverse rotation of the cylinder 1 and tube 16**, and during a normal printing run.

In FIG. 4B, the stencil heading 5 is maintained clamped on studs 28 of the heading bar of the duplicator by means of the resilient clamping strip 29. During normal operation of the duplicator the stencil is adhered in the flat configuration on the ink screen by means of the ink in the stencil and the screen and any slight tendency for the heading strip 5 to lift from the studs will be resisted by the resilient clamping action of the strip 29.

When, as shown in FIG. 4A, the tail of the stencil is adhered to the tube 16 and both the tube 16 and the top cylinder 1 of the duplicator are rotated in the clockwise direction as viewed in FIG. 4A, the stencil will initially unwind from the top cylinder 1 with the tension exerted along a tangential direction as the point of separation of the stencil from the arcuately supported ink screen on the top cylinder 1 progresses towards the clamp 4*a*. Once the point of separation arrives at the clamp 4*a*, slightly before the configuration shown in FIG. 4A, the line of the tension will cease to be tangential and will then come closer to the radial direction as the clamp 4*a* descends around the duplicator top cylinder 1 until the radial component of the tension is such as to overcome the spring resistance of the resilient strip 29 and to lift it to allow the stencil heading strip 5 to pull clear of the studs 28.

With this embodiment, there will be no need for the duplicator to be stopped to release the stencil heading strip once the stencil heading clamp 4 arrives at the top of the top cylinder 1 since release will be automatic.

FIG. 5A and 5B show a modification to the standard duplicator ink screen to allow the bottom bar of the ink screen to be readily attached to the slot 27 in the tube 16 without the need for the frusto-conical plug member 19 to be withdrawn from the tube 16 to allow insertion of the ink screen.

In this embodiment, the ink screen bottom bar 30 has a pair of resilient keying projections 31 on respective mounting strips 32 and it is a simple matter to clip the projections 31 resiliently into the slot 27 without removing the tube 16 from its support. Removal of the ink screen can then be carried out in the same way as the stencil removal process described above.

An alternative method of use of the apparatus illustrated in FIG. 2 is one in which the trailing edge of the stencil or of an ink screen is adhered either to one sheet of paper or between two separate sheets and is then fed into the slot 27 to be retained frictionally while the tube 16 is rotated to wind the stencil or ink screen off the duplicator. This method does not require the use of a folded paper core for the removal of a stencil.

Once the stencil or ink screen is fully supported on the tube 16 it is a simple matter to release the frusto-conical plug 19, to swing the tube 16 to one side, and then to slide the stencil or ink screen axially off the tube 16 along with the sheet or sheets of paper threaded into the slot with the stencil or ink screen.

The present invention, therefore, provides a means of rolling up an individual stencil or an individual ink screen from the duplicator and allowing that stencil or screen to be safely held until some convenient later time when, without necessitating switching off of the duplicator, the stencil or ink screen and the supporting core or tube can be removed from the apparatus and either disposed of in the case of a used stencil which is no longer required, or stored in the case of an ink screen or a stencil which requires re-use at some later time.

By providing an individual core for each stencil to be removed, the apparatus of the present invention enables much simpler recovery of a stencil than is possible in the device of U.S. Pat. No. 3,788,221 (Borneman) where a succession of stencils of which some may be unwanted and some may be required for re-use is automatically injected into a spiral build-up of blotting web on a receiving roller. By providing cheap, lightweight and readily disposable cores such as the sleeves 23, each of which cores receives one stencil or ink screen at a time and each of which cores can readily be removed for storage or disposal, the present invention provides a break-through in stencil duplicator operation which makes considerable economies in the operating time of the duplicator without requiring cumbersome and complicated modifications to the basic duplicator structure.

We claim:

1. A duplicator comprising:

(a) rotatable duplicator cylinder means;

(b) a stencil-supporting ink screen mounted on said duplicator cylinder means to circulate about said duplicator cylinder means during rotation of said cylinder means in use of the duplicator and adapted to carry a stencil;

(c) core means for receiving said stencil or ink screen;

(d) means for mounting said core means alongside said duplicator cylinder means;

(e) first drive transmission means driveably connected to said duplicator cylinder means normally driving said duplicator cylinder means in a first direction of rotation;

(f) second drive transmission means driveably connected between said first drive transmission means and said means for mounting said core means alongside said duplicator cylinder means, for driving said core means in rotation, said second drive transmission means and said core means being dimensioned to ensure that the peripheral speed of said core means when driven by said second drive transmission means is higher than the peripheral speed of said duplicator cylinder means;

(g) torque-limiting frictional engagement means in said second drive transmission means to limit the driving torque to said core mounting means to a value lower than that required to rupture said stencil or ink screen during rotation of said duplicator cylinder means in a direction opposite to said first direction during transfer to said core means; and (h) a one-way clutch in said second drive transmission means and arranged to transmit drive to the core means during rotation of said duplicator cylinder means in said opposite direction of rotation and to freewheel during rotation of said duplicator cylinder means in said first direction.

2. A duplicator comprising:

(a) duplicator cylinder means;

(b) a stencil-supporting ink screen mounted on said duplicator cylinder means to circulate about said duplicator cylinder means in use of the duplicator and adapted to carry a stencil;

(c) core means for receiving said stencil or ink screen;

(d) means for mounting said core means alongside said duplicator cylinder means and comprising a rotatable cylindrical core support member, said core means comprising a sleeve frictionally carried by said cylindrical core support member to impart a torque-limiting, friction-slip connection between said sleeve and said cylindrical core support member;

(e) first drive transmission means drivably connected to said duplicator cylinder means;

(f) second drive transmission means driveably connected between said first drive transmission means and said rotatable cylindrical core support member, for driving said rotatable cylindrical core support member in rotation, said second drive transmission means and said cylindrical core support member being dimensioned to ensure that the peripheral speed of said cylindrical core support member when driven by said second drive transmission means is higher than the peripheral speed of said duplicator cylinder means; and (g) a one-way clutch in said second drive transmission means and arranged to transmit drive to said cylindrical core support member only during rotation of said duplicator cylinder means in a sense of rotation opposite to the normal sense of rotation applicable during printing.

3. A stencil duplicator comprising:

(a) duplicator cylinder means;

(b) a stencil-supporting ink screen mounted on said duplicator cylinder means to circulate about said duplicator cylinder means in use of the duplicator and adapted to carry a stencil;

(c) core means for receiving said stencil or ink screen;

(d) means for mounting said core means alongside said duplicator cylinder means and comprising a rotatable cylindrical core support member, said core means comprising a sleeve frictionally carried by said cylindrical core support member to impart a torque-limiting, friction-slip connection between said sleeve and said cylindrical core support member;

(e) first drive transmission means driveably connected to said duplicator cylinder means;

(f) second drive transmission means driveably connected between said first drive transmission means and said rotatable cylindrical core support member, for driving said cylindrical core support member in rotation, said second drive transmission means and said cylindrical core support member being dimensioned to ensure that the peripheral speed of said cylindrical core support member when driven by said second drive transmission means is higher than the peripheral speed of said duplicator cylinder means;

(g) torque-limiting frictional engagement means comprising friction slip belt drive means in said second drive transmission means to limit the driving torque to said cylindrical core support member to a value lower than that required to rupture said stencil or ink screen when being transferred to said core means, and the lmiting torque transmissable from said support member to said sleeve is such that said sleeve slips on said support member before slip in the belt drive means; and (h) a one-way clutch in said second drive transmission means and arranged to transmit drive to said rotatable core support member only during rotation of said duplicator cylinder means in a sense of rotation opposite to the normal sense of rotation applicable during printing.

4. A duplicator as set forth in claim 3, wherein said sleeve comprises a tube of paper folded flat about fold lines extending along diametrically opposite generatrices of the sleeve.

5. A duplicator comprising:

(a) duplicator cylinder means;

(b) a stencil-supporting ink screen mounted on said duplicator cylinder means to circulate about said duplicator cylinder means in use of the duplicator amd adapted to carry a stencil;

(c) core means for receiving said stencil or ink screen;

(d) means for mounting said core means alongside said duplicator cylinder means;

(e) first drive transmission means driveably connected to said duplicator cylinder means;

(f) second drive transmission means, driveably connected between said first drive transmission means and said means for mounting said core means alongside said duplicator cylinder means; for driving said core means in rotation; said second drive transmission means including: a first pulley fast for rotation with said duplicator cylinder means; a second pulley disposed coaxially with said core means; and a drive belt extending between said first and second pulleys for limited torque, drive-transmitting, frictional engagement therewith; said first and second pulleys and said core means being dimensioned to ensure that the peripheral speed of said core means when driven by said second drive transmission means is higher than the peripheral speed of said duplicator cylinder means; and said limited torque having a value lower than that required to rupture said stencil or ink screen when being transferred to said core means; and (g) a one-way clutch connecting said second pulley to said core means and arranged to transmit drive to the core means only during rotation of said duplicator cylinder in a sense of rotation opposite to the normal sense of rotation applicable during printing.

6. A duplicator as set forth in claim 5, wherein said drive belt has a circular cross-section.

7. A duplicator as set forth in claim 5, wherein said core means is in the form of a rigid tube driven by said second drive transmission means to have a peripheral speed higher than that of the duplicator cylinder when there is no slip at said friction slip belt drive means.

8. A duplicator as set forth in claim 7, wherein said tube includes means defining a longitudinal slot extending from close to one end of said tube right up to the other end of said tube.

9. A duplicator as set forth in claim 7, wherein said means for mounting said core means adjacent said duplicator cylinder means includes: an idler core support member disposed to engage one end of said tube; a driven core support member at the other end of said tube, said driven core support member being in driven engagement with said second drive transmission means; and means mounting said idler core support member for movement axially to release said one end of the tube to allow said tube to be pulled aside for removal of the stencil or ink screen when supported thereon.

10. A duplicator as set forth in claim 9, and including releasable rotation-drive transmitting connector means engageable between the said tube and the said driven member.

11. A duplicator as set forth in claim 5, wherein said second drive transmission means includes torque-transmitting universal ball joint means carried by said second pulley, and said one-way clutch in said second drive transmission is formed integrally with said second pulley and said universal ball joint means and is disposed between said second pulley and said universal ball joint means.

* * * * *